US006461112B1

(12) United States Patent
Ohta et al.

(10) Patent No.: US 6,461,112 B1
(45) Date of Patent: Oct. 8, 2002

(54) SCREW COMPRESSION APPARATUS AND OPERATION CONTROL METHOD THEREOF

(75) Inventors: Hiroshi Ohta; Masakazu Aoki, both of Shimizu; Hiroyuki Matsuda, Yaizu; Hitoshi Nishimura, Shimizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/671,305

(22) Filed: Sep. 28, 2000

(30) Foreign Application Priority Data

Jun. 2, 2000 (JP) ..... 2000-165444

(51) Int. Cl.[7] ..... F04B 49/00
(52) U.S. Cl. ..... 417/26; 417/18
(58) Field of Search ..... 417/26, 53, 63, 417/18, 297

(56) References Cited

U.S. PATENT DOCUMENTS

| | | | | |
|---|---|---|---|---|
| 4,336,001 A | * | 6/1982 | Andrew et al. | 417/63 |
| 5,531,571 A | | 7/1996 | Van Dyck | |
| 5,820,352 A | * | 10/1998 | Gunn et al. | 417/53 |
| 6,244,824 B1 | * | 6/2001 | Centers | 417/18 |
| 6,287,088 B1 | * | 9/2001 | Nishimura et al. | 417/297 |

FOREIGN PATENT DOCUMENTS

| | | | | |
|---|---|---|---|---|
| DE | 2717224 | | 10/1978 | |
| DE | 2847311 | | 9/1979 | |
| EP | 0085285 | | 8/1983 | |
| EP | 0684385 | | 11/1995 | |
| JP | 406081782 | * | 3/1994 | F04C/18/16 |
| JP | 409209949 | * | 8/1997 | F04C/18/16 |

OTHER PUBLICATIONS

Patent Abstracts of Japan, M–1593 Apr. 15, 1994, vol. 18, No. 212.
Patent Abstracts of Japan, M–1689 Oct. 19, 1994 vol. 18, No. 548.
Patent Abstracts of Japan, M–1629 Jun. 28, 1994, vol. 18, No. 341.
Patent Abstracts of Japan, M–1609, Jan. 11, 1991, vol. 15, No. 13.

* cited by examiner

*Primary Examiner*—Teresa Walberg
*Assistant Examiner*—Leonid M Fastovsky
(74) *Attorney, Agent, or Firm*—Antonelli, Terry, Stout & Kraus, LLP

(57) ABSTRACT

In a capacity control method for an oil-free screw compressor, when an air consumption is larger than a set amount, a rotation frequency of a motor using an inverter to drive the compressor is set to be variable. When the air consumption is a set air amount or less, the inverter is controlled in such a manner that the rotation frequency of the motor is kept at a constant value. In this state, when an operation gas pressure of the compressor reaches an upper-limit value, an air release valve is opened to discharge the operation gas to the atmosphere. Additionally, the rotation frequency of the motor is lowered to a lower-limit value. Re-compression in the compressor can be prevented, and a compressor drive torque is lowered.

15 Claims, 5 Drawing Sheets

SCREW COMPRESSION APPARATUS AND OPERATION CONTROL METHOD THEREOF

BACKGROUND OF THE INVENTION

The present invention relates to a screw compression apparatus and an operation control method thereof, particularly to a preferred screw compression apparatus and an operation control method thereof in which an inverter drive motor is used to control a capacity of a compressor body, the compressor body includes a pair of screw rotors, and the rotors are synchronously rotated in a non-contact manner to compress air and other operation gases.

As a compressor body for use in a screw compression apparatus, there are known an oil-free screw compressor, provided with a pair of screw rotors connected to each other via a timing gear, for synchronously rotating the pair of screw rotors in a non-contact and oil-free state, and an oil-cooled screw compressor for supplying oil to the pair of screw rotors, which mesh with each other, to rotate the rotors.

An example in which the oil-free screw compressor is used is disclosed in Japanese Patent Unexamined Publication No. 06-18584. In the compressor disclosed in the publication, a suction throttle valve is provided in a suction air passage of the compressor, and an air release valve for releasing compressed air from an air conduit on a suction side of a check valve is disposed midway in a compressor discharge air passage on an upstream side from a check valve. Moreover, during full-load operation, the suction throttle valve is opened and the air release valve is closed. Furthermore, a discharge pressure rises as an amount of air usage on a load side decreases. When a pressure detector detects an upper-limit pressure, the suction throttle valve is closed and the air release valve is opened.

On the other hand, another example is disclosed in Japanese Patent Unexamined Publication No. 09-287580 in which the oil-cooled screw compressor is operated by using an inverter drive motor. In this publication, an inverter is used to control a revolutional speed of the compressor in a compressor operating range in which the amount of the air consumption ranges from about 30% to 100% with respect to a specified discharge air amount as a discharge air amount in a rated output. Moreover, when the amount of the air usage is 30% or less of the specified discharge air amount and the discharge pressure (the pressure on the delivery side of the check valve) reaches a set pressure, the screw compressor continues to be operated at a set lower-limit rotation speed in the revolution number control. Furthermore, the suction throttle valve is closed to decrease the discharge pressure, and change-over to an unload operation is performed.

The aforementioned conventional oil-free screw compressor has an advantage that no oil is mixed into operation gases such as air, but no inverter is used and it is therefore difficult to arbitrarily adjust the rotation speed of the compressor.

On the other hand, in the aforementioned conventional oil-cooled screw compressor, since the inverter is used, the compressor rotation speed can be adjusted. However, since a lubricant oil or a cooling oil is mixed in the operation gas, it is necessary to separate the mixed oil after compression.

To solve the problem, it is considered that by applying the inverter used for the oil-cooled screw compressor to the oil-free compressor, cleaning of the operation gas and variable speed operation of the compressor can both be realized. However, even when the inverter is simply employed to keep the discharge pressure of the oil-free screw compressor to be a specified pressure, a ratio of an internal air leak amount to a swept air amount increases in a compressor low rotation speed area. As a result, there is a possibility that air having leaked to the upstream side is compressed again in a compressor compression chamber. When such phenomenon occurs, a compressed air temperature rises, and at a certain rotation speed or less, it becomes difficult to operate the compressor.

Moreover, for the compressor operated at the specified pressure, since an allowance between the upper limit value of the discharge pressure at which the compressor reaches its critical temperature, and the specified pressure becomes very small, there is a possibility that the upper-limit pressure is exceeded when controlling the rotation speed.

BRIEF SUMMARY OF THE INVENTION

An object of the present invention is to provide a screw compression apparatus in which power consumption is reduced when changing a low load operation to an unload operation from a low load operation.

To attain the aforementioned object, according to a first aspect of the present invention, there is provided a screw compression apparatus comprising: a screw compressor including a pair of female and male rotors; a motor, controlled by an inverter, for driving the compressor; pressure detecting means for detecting a pressure of an operation gas discharged from the screw compressor (a pressure on a delivery side of a check valve); and an air release valve for performing a control to release the operation gas compressed by the compressor (the gas on a suction side of the check valve) to the atmosphere. The apparatus further comprises control means for controlling the motor and the air release valve. The control means controls rotation frequency of the motor by the inverter at an operation point at which a ratio of an air consumption on a user side to a specified compressor discharge amount is larger than a predetermined set value, holds the rotation frequency of the motor at a constant value when the ratio indicates the set value or less, controls the air release valve to release the operation gas (the gas on the suction side of the check valve) to the atmosphere after the pressure detected by the pressure detecting means reaches a set upper-limit pressure, and further lowers the rotation frequency of the motor after the pressure of the operation gas (the pressure on the delivery side of the check valve) reaches the upper-limit pressure.

In this aspect, when the operation gas pressure (the pressure on the delivery side of the check valve) reaches the set upper-limit pressure, the control means controls the air release valve and motor to release the operation gas (the gas on the suction side of the check valve) to the atmosphere via the air release valve and to lower the rotation frequency of the motor. There is provided a suction throttle valve for controlling an operation gas amount sucked by the compressor. When the amount of the air consumption indicates the set value or less of the air consumption ratio, the control means closes the suction throttle valve and releases the operation gas to the atmosphere via the air release valve, and subsequently controls the motor to further lower the rotation frequency of the motor. Alternatively, another air release valve may be provided in parallel to the air release valve.

To attain the aforementioned object, according to a second aspect of the present invention, there is provided an operation control method of a screw compression apparatus comprising: a screw compressor driven by a motor having an inverter; and pressure detecting means for detecting a pressure of an operation gas discharged from the compressor, the method comprising the steps of: controlling rotation frequency of the motor by the inverter when an air consumption on a demand side is larger than a predetermined set value; holding the rotation frequency of the motor at a constant value when the amount of the air consumption indicates the set value or less; controlling the air release valve to release the operation gas to the atmosphere when the pressure detected by the pressure detecting means reaches a set upper-limit pressure in this state; and further lowering the rotation frequency of the motor during or after air release.

Moreover, in this aspect, when the pressure of the operation gas indicates the set upper-limit pressure, the operation gas is released to the atmosphere via the air release valve and the rotation frequency of the motor is lowered. A suction throttle valve for controlling an operation gas amount sucked by the compressor is provided. When the amount of the air consumption indicates the set value or less, the suction throttle valve is closed and the operation gas is released to the atmosphere via the air release valve, and subsequently the rotation frequency of the motor may further be lowered.

To attain the aforementioned object, according to a third aspect of the present invention, there is provided an operation control method of a screw compression apparatus comprising: a screw compressor driven by a motor having an inverter; and pressure detecting means for detecting a pressure of an operation gas discharged from the compressor, the method comprising the steps of: holding a rotation frequency of the motor at a first rotation frequency when an amount of an air consumption indicates a predetermined set value or less; and controlling the rotation frequency of the motor to provide a second rotation frequency thereof lower than the first rotation frequency after the pressure detected by the pressure detecting means reaches a set upper-limit pressure in this state.

In this aspect, when the motor is held at the first rotation frequency and the pressure detected by the pressure detecting means reaches the set upper-limit pressure, the operation gas compressed by the compressor is released to the atmosphere. When the motor is operated at the second rotation frequency, before the amount of the air consumption returns to the set value, the motor is operated at a frequency higher than the second rotation frequency. When the motor is operated at the second rotation frequency and the operation gas is released to the atmosphere, the motor is decelerated to provide a lower-limit frequency. This state is held until the air consumption reaches the set value. Subsequently, when the set value is obtained, the air release may be stopped after accelerating the motor to obtain the first rotation frequency.

DETAILED DESCRIPTION OF THE INVENTION

Figure 1:
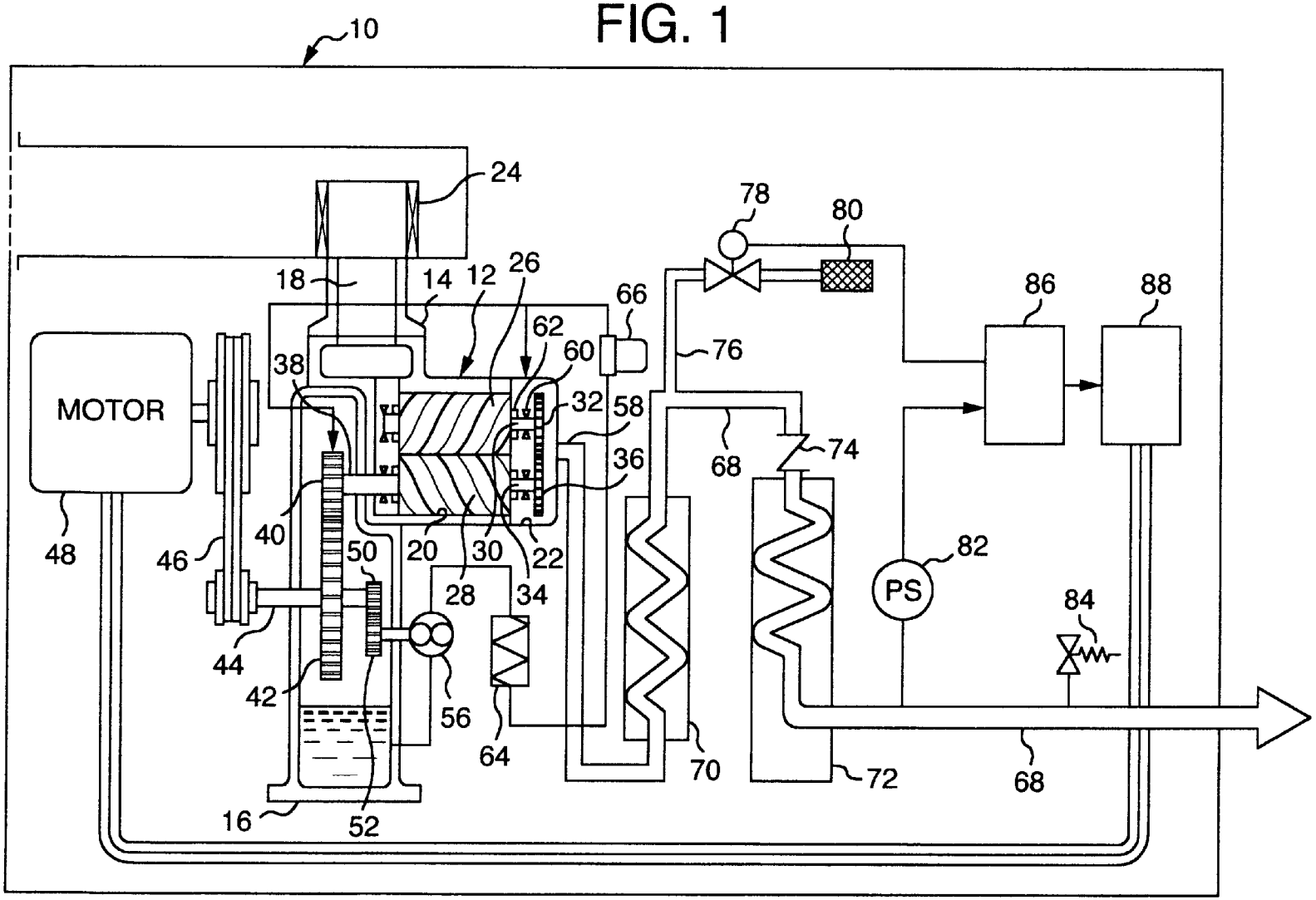
FIG. 1 is a schematic diagram showing the entire constitution of one embodiment of a screw compression apparatus according to the present invention.

Some embodiments according to the present invention will be described hereinafter with reference to the drawings. FIG. 1 is a block diagram of one embodiment of a screw compression apparatus according to the present invention. In FIG. 1, a screw compression apparatus 10 is provided with an oil-free screw compressor 12 which is operated by an inverter drive motor 48. A casing 14 of the compressor 12 is fixed to a gear case 16. The inside of the casing 14 is divided into an air passage 18, a compression chamber 20 and a gear chamber 22. The air passage 18 is connected to a suction filter 24 at an end thereof.

Atmospheric air as an operation gas is introduced into the compression chamber 20 of the compressor 12 via the suction filter 24 and air passage 18. In the compression chamber 20, a pair of screw rotors, that is, a female rotor 26 and a male rotor 28 are rotatably contained in a non-contact state. The female rotor 26 is connected to a timing gear 32 via a rotation shaft 30, and the male rotor 28 is connected to a timing gear 36 via a rotation shaft 34. The timing gears 32 and 36 mesh with each other.

A small-diameter gear 40 is attached to an end of a rotation shaft 38 of the male rotor 28 disposed on the opposite side to the rotation shaft 34. This gear 40 meshes with a large-diameter gear 42. The gear 42 is fixed to a middle portion of a rotation shaft 44, and a pulley for attaching a belt 46 is fixed to one end of the rotation shaft 44. The belt 46 is driven by the motor 48. A gear 50 is attached to the rotation shaft 44 on a side opposite to an belt 46 attaching side. The gear 50 meshes with a gear 52. An oil pump 56 is connected to one end of a shaft 54 to which the gear 52 is attached.

The motor 48 is a three-phase induction motor, and the rotation speed is controlled by using an inverter 88. When the motor 48 is rotated/driven, a drive force of the motor 48 is transmitted to the male rotor 28 in order of the belt 46, rotation shaft 44, gears 42, 40 and rotation shaft 38. When the timing gear 36 disposed on the end of the male rotor 28 rotates together with the male rotor 28, the timing gear 32 disposed on the male rotor 26 to mesh with the timing gear 36 rotates, and the female rotor 26 therefore rotates in synchronization with the male rotor 28. Since the timing gears 32, 36 are disposed, the female rotor 26 and the male rotor 28 can rotate in an oil-free and non-contact state.

Grooves are formed in respective outer peripheries of the female rotor 26 and the male rotor 28, and the operation gas flows in the grooves. When the female rotor 26 and the male rotor 28 rotate with each other, air introduced into an operation gas passage formed by the groove is successively compressed. The compressed air is discharged via a discharge port 58. A pressure of the compressed air discharged from the discharge port 58 is 0.69 MPa, and a temperature thereof is about 350° C.

Additionally, each of the rotation shafts 30, 34, 38 is rotatably supported by a bearing 60, respectively. A shaft seal 62 for preventing oil from entering the compression chamber 20 is provided around the respective rotation shafts 30, 34, 38. Moreover, oil in the gear case 16 is supplied to the respective gears 32, 36, 40, 42, 50, 52 via an oil cooler 64 and an oil filter 66 by the oil pump 56.

The discharge port 58 of the compressor 12 is connected to a discharge air piping 68. An end of the discharge air piping 68 is connected to an air tank (not shown) on a load side. A pre-cooler 70 for primarily cooling the compressed air and an after-cooler 72 for secondarily cooling the compressed air cooled by the pre-cooler 70 are provided midway in a pipeline of the discharge air piping 68. A check valve 74 for preventing air from returning is provided in a conduit between the pre-cooler 70 and the after-cooler 72. The discharge air piping 68 between the pre-cooler 70 and the check valve 74 is provided with a branch portion, and an air release solenoid valve 78 is provided on a pipeline end of a branch piping 76 branched from the branch portion. The air release solenoid valve 78 is connected to an air release silencer 80.

The discharge air piping 68 on the downstream side from the after-cooler 72 is provided with a pressure sensor 82 for detecting a discharge pressure and a safety valve 84. When the pressure in the discharge air piping 68 reaches a blow-out pressure, the safety valve 84 releases the compressed air in the discharge air piping 68 to the atmosphere. The output of the pressure sensor 82 is inputted to a controller 86. The controller 86 compares discharge pressure detected by the pressure sensor 82 with a set pressure or an upper-limit pressure, and outputs a control signal to the inverter 88 in accordance with the comparison result. Moreover, when the pressure detected by the pressure sensor 82 reaches the upper-limit pressure, a command is outputted to open the air release solenoid valve 78.

The inverter 88 is provided with a converter portion for converting a three-phase alternating current supplied from a three-phase alternating-current power source to a direct current, and an inverter portion for re-converting an output of the converter portion to the three-phase alternating current. Moreover, based on the control signal sent from the controller 86, respective switching elements of the converter and inverter portions perform switching operation. An output frequency and an output voltage are controlled in accordance with a switching timing of each switching element. When the output frequency of the inverter 88 changes, the rotation speed of the motor 48 changes in accordance with the output frequency change. Thereby, the inverter 88, together with the controller 86, controls the rotation speed of the motor 48 based on a detection output of the pressure sensor 82.

An operation control method of the screw compressor 12 constituted as described above according to the present embodiment will be described with reference to FIGS. 2 and 3. In general, when an air amount discharged from the compressor 12 indicates a specified air amount, the amount is regarded as 100% discharge air amount. Up to the discharge air amount which is 35% of the specified air amount, the rotation speed of the motor 48 is controlled to change the discharge air amount of the compressor 12. In this case, a discharge air pressure is set to be constant. When the discharge air amount of the compressor 12 is controlled to provide 35% or less of the specified air amount, the rotation speed of the motor 48 is set to the rotation speed in the discharge air amount of 35% of the specified air amount. Subsequently, the air release solenoid valve is opened. This respect will be described hereinafter in more detail.

A load state of the screw compressor 12 is monitored by the pressure detected by the pressure sensor 82. Moreover, the pipeline end of the discharge air piping 68 is connected to an air tank (not shown). When the compressor 12 discharges the air amount in a range of 35% to 100% of the specified discharge air amount (=air consumption), the controller 86 and the inverter 88 change the rotation frequency of the motor 48 in a range of a low speed side set frequency f1 to a maximum frequency fmax based on the pressure detected by the pressure sensor 82. Thereby, the number of revolutions of the motor is controlled in such a manner that the discharge pressure of the compressor 12 indicates a set pressure P0, for example, 0.69 MPa. Since the revolution number of the motor is controlled, even if an amount of air consumed by a load is reduced, by operating the motor 48 at a constant rotation speed, the discharge pressure of the compressor 12 can be prevented from being higher than the set pressure P0.

When the air consumption indicates 35% or less of the specified discharge air amount, the rotation frequency of the motor 48 is held at the low speed side set frequency f1 under constant pressure control. This is because by reducing the rotation speed with the constant pressure even in a low load area in which the air consumption is 35% or less at an air consumption ratio (value obtained by dividing the air consumption by a used discharge air amount), a ratio of an internal air leak amount with respect to a swept air amount increases in the compressor 12, internal leak air is re-compressed in the compression chamber 20, and temperature rises in the compressor 12.

Figure 2:
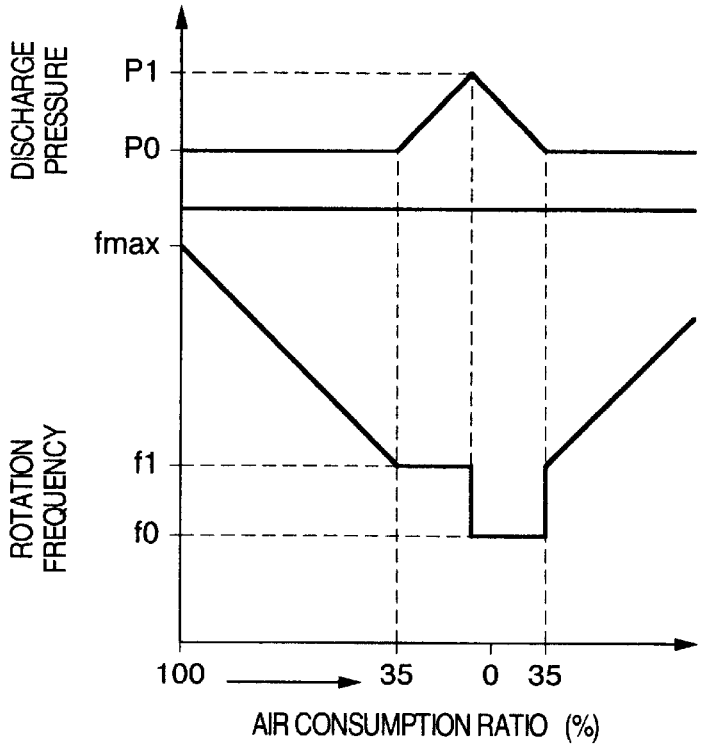
FIG. 2 is an explanatory view of a relation between discharge pressure and motor rotation frequency with respect to a discharge air amount ratio.

To solve the problem, in the present embodiment, as shown in FIG. 2, the motor is operated at the low speed side set frequency f1, and the air release solenoid valve 78 is changed to an opened valve state from a closed valve state when the discharge pressure reaches an upper-limit pressure P1 (0.71 MPa). When the air release solenoid valve 78 is opened, the discharge pressure is reduced, and the temperature therefore lowers in the compression chamber 20. This state is called as an unload operation. When the unload operation is continued, and as a result the air consumption indicates an air consumption ratio of 35%, the rotation frequency of the motor 48 is changed to a frequency higher than the low speed side set frequency f1.

Figure 3:
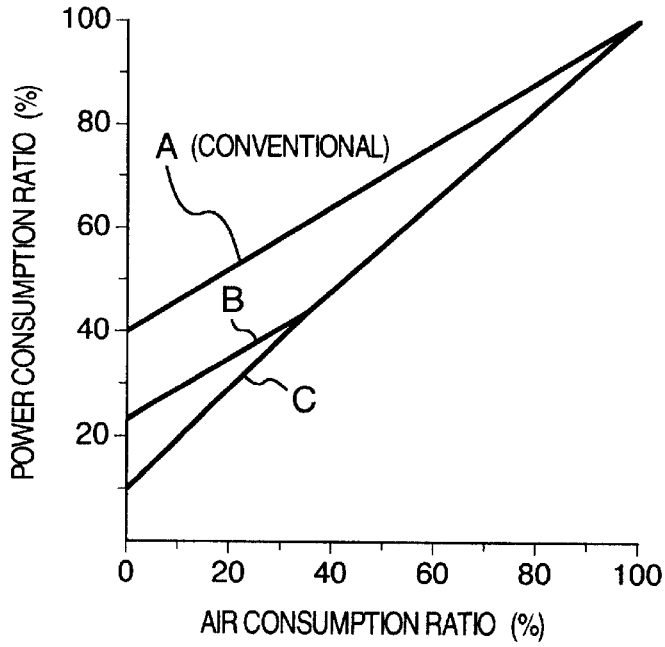
FIG. 3 is an explanatory view of a relation between the discharge air amount ratio and a power consumption ratio.

According to the present embodiment, since the unload operation is performed, as shown by characteristic B of FIG. 3, power consumption can be reduced. Additionally, characteristic A of FIG. 3 shows a power consumption characteristic of an oil-free screw compressor in which no control is performed over the revolution speed. As apparent from FIG. 3, in the system of the present embodiment, the power consumption ratio can be reduced by 15% or more as compared with a conventional system.

When the operation is shifted to the unload operation by opening the air release solenoid valve 78, the rotation frequency of the motor 48 is further decreased to a lower-limit frequency of from the low speed side set frequency f1. This is called the unload operation by two-step speed reduction control. When the two-step speed reduction control is used, a characteristic C is obtained as shown in FIG. 3, and the power consumption during the unload operation can further be reduced as compared with the characteristic B.

When the unload operation by the two-step speed reduction control is performed, at the air consumption ratio of 0%, the power consumption is about ¼ as compared with the conventional system shown by the characteristic A, and the power consumption is about ½ as compared with the unload operation by one-step speed reduction control shown by the characteristic B.

As described above, in the present embodiment, when the motor 48 is operated at the low speed side set frequency f1, and the discharge pressure exceeds the upper-limit pressure P1, since the air release solenoid valve 78 is opened to perform the unload operation, the temperature in the compression chamber 20 can be inhibited from rising. Moreover, the power consumption can be reduced. Furthermore, by the two-step speed reduction control in which the rotation frequency of the motor 48 is decreased to the lower-limit frequency of from the low speed side set frequency f1, the power consumption during the unload operation can further be reduced. Moreover, by performing speed reduction operation of the compressor in the low load area, a suction air amount is reduced, and the two-step speed reduction control can be performed without providing the suction throttle valve on an inlet side of the screw compressor 12.

Figure 4:
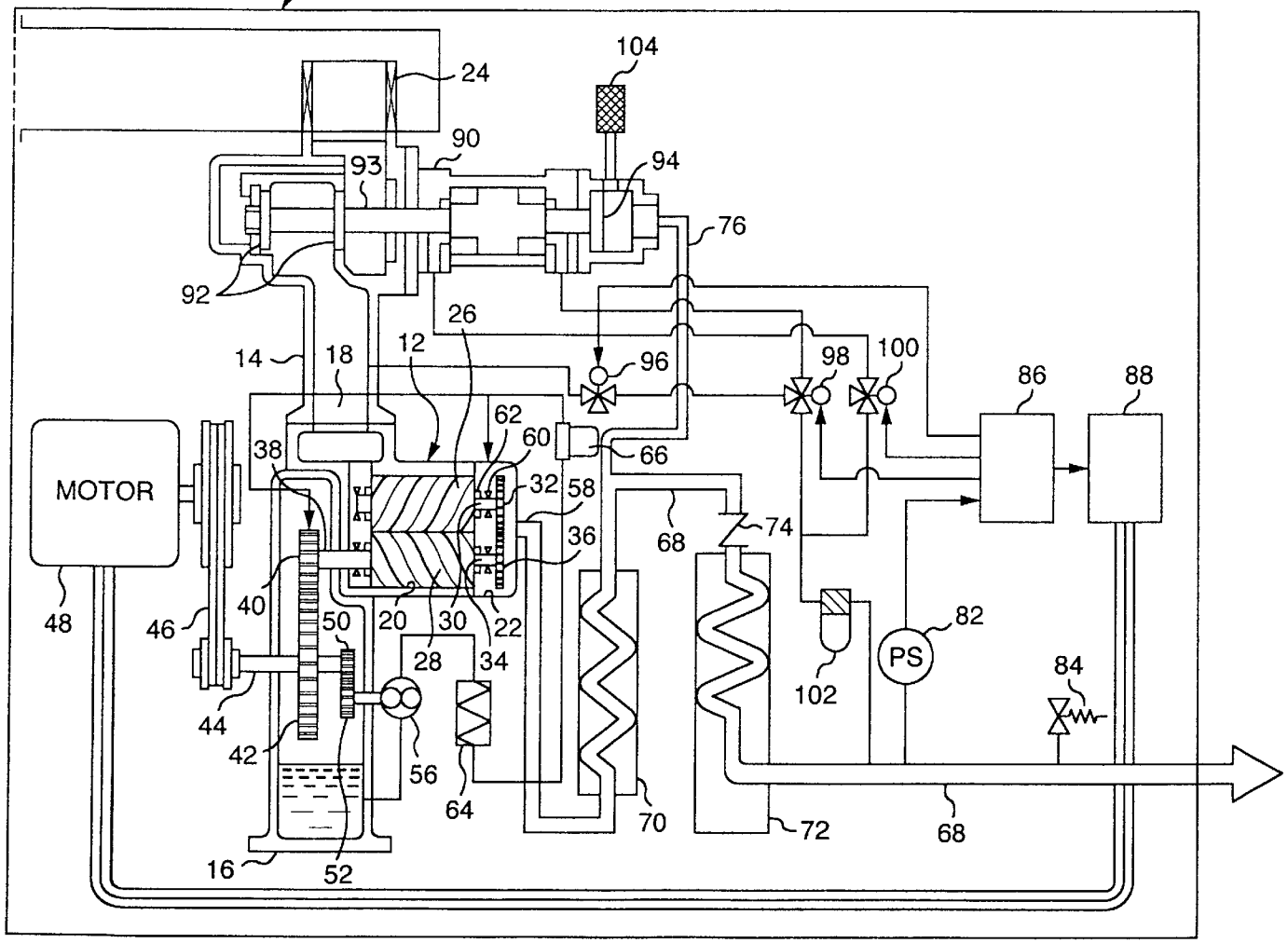
FIGS. 4 and 5 are schematic diagrams showing the entire constitution of another embodiment of the screw compression apparatus according to the present invention.

Another embodiment of the present invention is shown in FIG. 4. The embodiment is different from the embodiment shown in FIG. 1 in that the suction throttle valve is provided, and that the air release valve is provided on the side of the suction throttle valve. A casing 90 formed integrally with the casing 14 of the compressor 12 is connected to the suction filter 24, and a suction throttle valve 92 and an air release valve 94 are disposed in the casing 90. Moreover, the suction throttle valve 92 is connected to the air release valve 94 via a connection shaft 93. As a result, the suction throttle valve 92 and air release valve 94 can be opened/closed in a cooperative manner. Moreover, three-way solenoid valves 96, 98, 100 are provided, and the compressed air is extracted from the discharge air piping 68 on the downstream side of the after-cooler 72 via a filter 102. The compressed air is supplied to the downstream side of the suction throttle valve 92 in the casing 90, a portion between the suction throttle valve 92 and the air release valve 94, and an upstream side of the air release valve 94 via the three-way solenoid valves 96, 98, 100, and is used as a drive source of the respective valves 92, 94.

Additionally, the opening/closing of the three-way solenoid valves 96, 98, 100 is controlled by the controller 86. The air release valve 94 is connected to the piping 76. Since the compressed air passed through the air release valve 94 is released to the atmosphere, the casing 90 is provided with an air release silencer 104.

In the present embodiment, when the air consumption is in a range of 35% to 100% of the specified discharge air amount, the suction throttle valve 92 is opened, and the pipeline end of the piping 76 is closed by the air release valve 94. Additionally, FIG. 4 shows that the suction throttle valve 92 is closed and the air release valve 94 is opened. To maintain the discharge pressure at the set pressure P0, the motor for driving the compressor 12 is subjected to the speed control.

When the air consumption is 35% or less of the specified air amount, the rotation frequency of the motor 48 is held at the low speed side set frequency f1. In this state, when the discharge pressure reaches the upper-limit pressure P1, the suction throttle valve 92 is closed. Additionally, the air release valve 94 is opened to reduce the discharge pressure. Thereafter, the rotation frequency of the motor 48 is decreased to the lower-limit frequency f0. According to the present embodiment, since the change-over to the unload operation is performed in the low load area, the temperature in the compression chamber 20 can be lowered. Moreover, the power consumption during the unload operation can be reduced.

Figure 5:
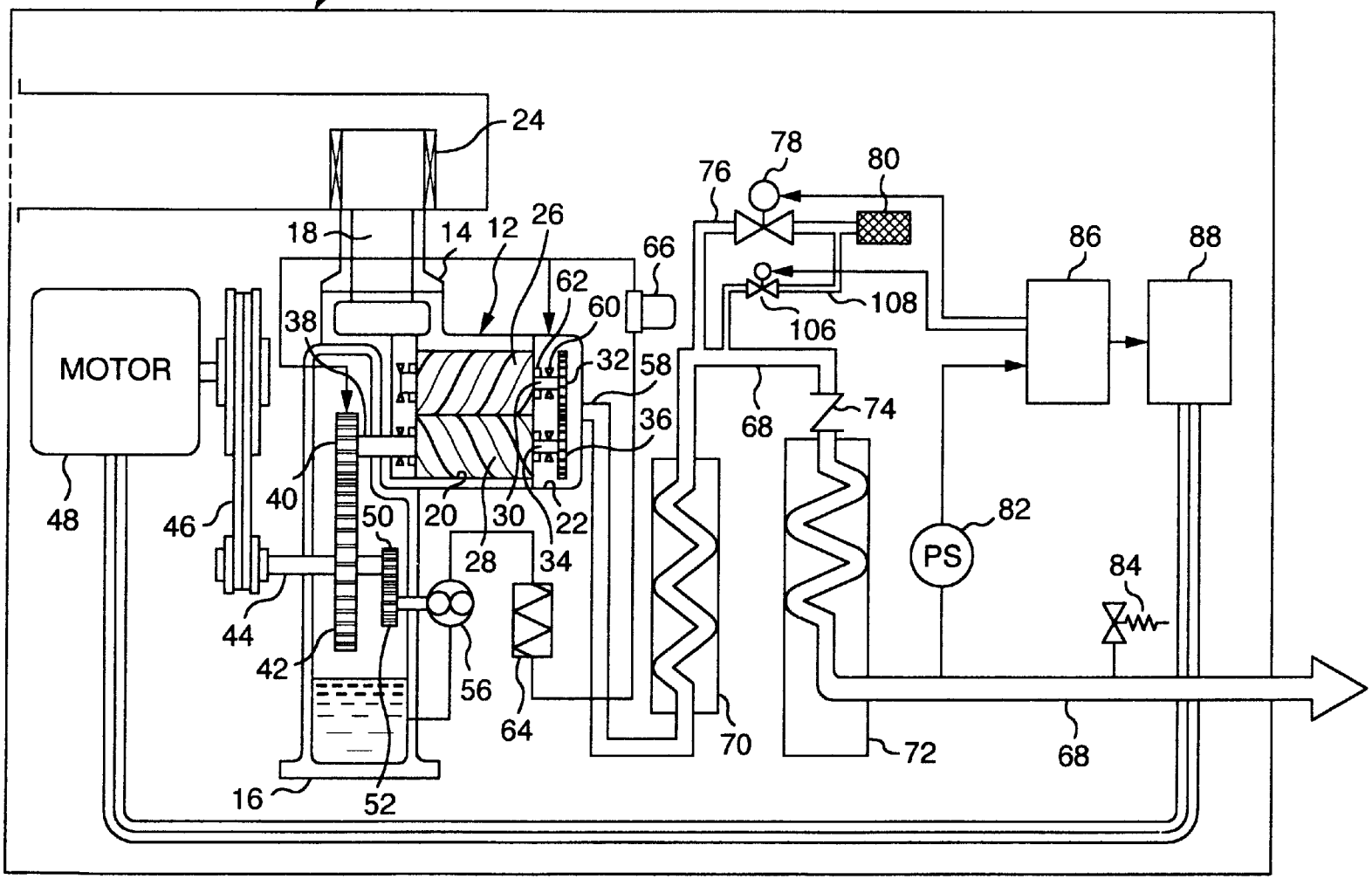

Next, still another embodiment of the present invention is shown in FIG. 5. The present embodiment is different from the embodiment shown in FIG. 1 in that a second air release solenoid valve 106 is provided parallel to the first air release solenoid valve 78. Additionally, the second air release solenoid valve 106 is disposed midway in a pipeline of a piping 108 with a pipeline diameter smaller than that of the piping 78. The controller 86 controls the opening/closing operation of the second air release solenoid valve 106.

The second air release solenoid valve 106 releases air with a pressure lower than the blow-out pressure of the safety valve 84 regardless of the operation state and the motor rotation frequency. When an air release pressure of the air release valve 106 is P3, the air release pressure P3 is set to be equal to or higher than the upper-limit pressure P1 shown in FIG. 2, or lower than a blow-out pressure P4 of the safety valve 84.

The second air release solenoid valve 106 releases air before the discharge pressure in the discharge air piping 68 rises and the safety valve 84 operates. Therefore, even with a rapid pressure rise in a totally closed state of the valve of a discharge side apparatus (load) during start, the air release valve 106 is opened, and therefore the discharge pressure in the discharge air piping 68 on the downstream side from the after-cooler 72 fails to exceed a pressure P3. Moreover, the temperature in the compression chamber 20 can be set to a critical point or less. Furthermore, a discharge pressure fluctuation can be reduced.

Even in the present embodiment, since the change-over to the unload operation is performed by opening the solenoid valve 78 in the low load area similarly as the embodiment shown in FIG. 1, the temperature in the compression chamber 20 is lowered. Moreover, the power consumption during the unload operation can be reduced.

A control method of the compressor after the rotation speed of the motor 48 is set to the low speed side set frequency f1 will next be described with reference to FIG. 6. When the air consumption is 35% or less of the specified discharge air amount, the operation frequency of the motor 48 is lowered to the low speed side set frequency f1, and this operation frequency is held. Since the air consumption decreases, the discharge pressure detected by a pressure sensor portion rises from the set pressure P0.

When the discharge pressure rises to the upper-limit pressure P1 (e.g., 0.71 MPa) from the set pressure P0 (e.g., 0.69 MPa), the discharge pressure is reduced by 0.1 MPa by opening the air release solenoid valve 78 provided between the compressor main body and the check valve. Additionally, the rotation frequency is lowered to the lower-limit frequency f0 (e.g., 20 Hz) from the low speed side set frequency f1 (e.g., 30 Hz) and the unload operation is executed. In the unload operation, the operation frequency of the motor is held at the lower-limit frequency f0. When the discharge pressure drops to the set pressure P0, the rotation frequency is increased to the low speed side set frequency f1 still in the unload operation.

At the low speed side set frequency f1, the air release solenoid valve 78 is closed, and the discharge pressure is held at the set pressure P0. In this case, time $\Delta T$ when the rotation frequency increases to the low speed side set frequency f1 from the lower-limit frequency f0 is generated as a time lag. As a result, the discharge pressure indicates a pressure between the upper-limit pressure P1 and a pressure (P0-$\Delta P$) obtained by decreasing the set pressure P0 by a slight amount. Additionally, the characteristic of the motor 48 at the time is shown by a characteristic D (solid line). Moreover, the discharge pressure of the compressor body is shown by a characteristic G (dashed line), and the pressure detected by the pressure sensor portion is shown by a characteristic F (solid line).

Figure 6:
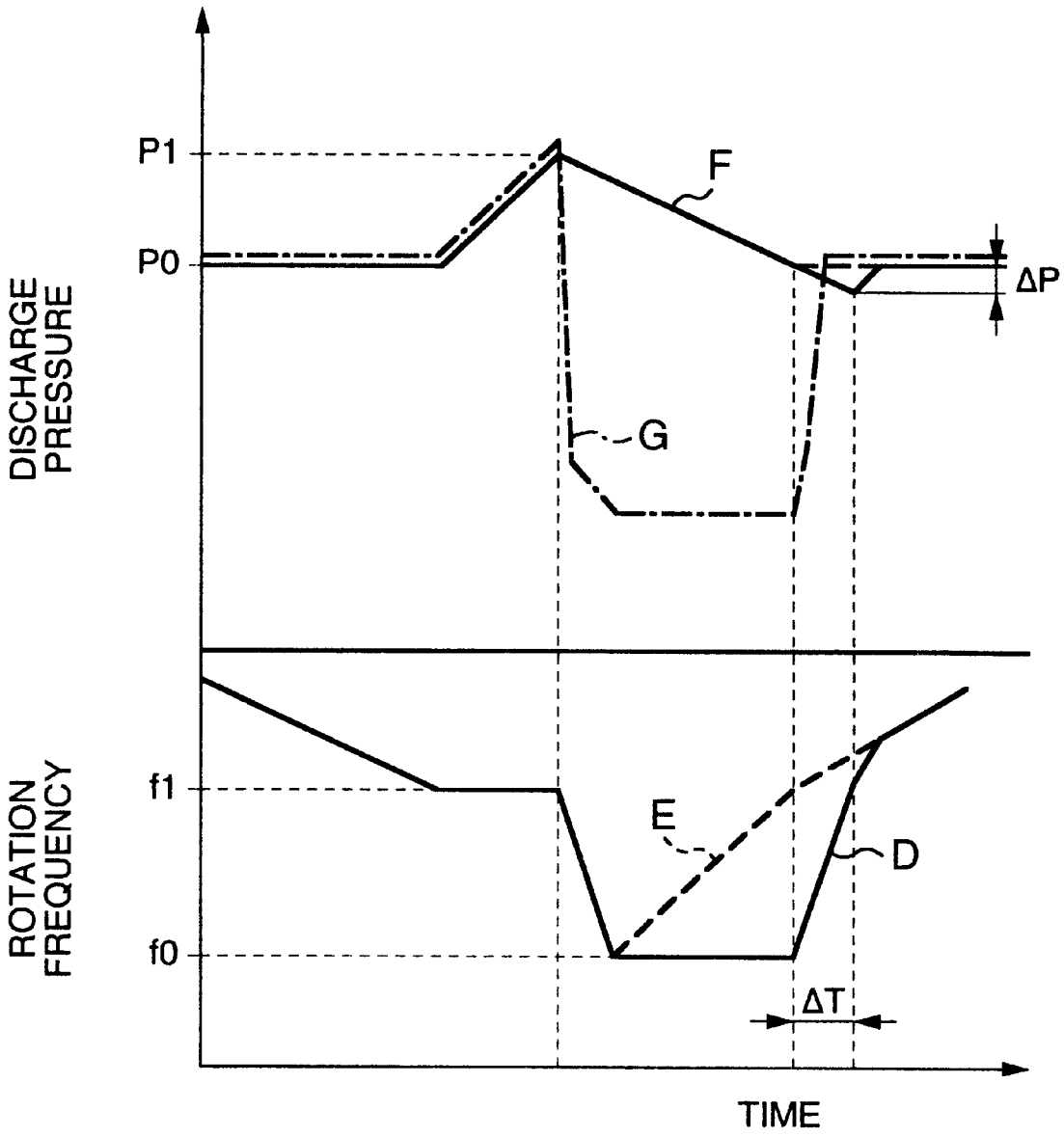
FIG. 6 is an explanatory view of changes of the discharge pressure and motor rotation speed of an inverter driving type oil-free screw compressor according to the present invention.

In order to reduce a pressure fluctuation-$\Delta P$ attributed to the time lag, as shown by a characteristic E in FIG. 6, the operation frequency of the motor may be controlled. Specifically, when the discharge pressure reaches the upper-limit pressure P1, the rotation frequency is reduced to the set minimum frequency f0 from the low speed side set frequency f1. Thereafter, when the discharge pressure drops to the set pressure P0 from the upper-limit pressure P1, the rotation frequency is increased still in the unload operation. In this case, when the discharge pressure reaches the set pressure P0, the rotation frequency is controlled to indicate the low speed side set frequency f1. When the revolution number of the motor is controlled in this manner, the time lag ΔT generated while the rotation frequency of the motor increases to the low speed side set frequency f1 from the set minimum frequency f0 can be eliminated. Moreover, by the absence of a pressure drop ΔP, the discharge pressure can easily be controlled to indicate the set pressure P0 even when the unload operation shifts to the revolution number control.

Oil supply during low rotation of the oil-free screw compressor 12 will next be described. In the oil-free screw compressor 12, as shown in FIG. 1, power of the motor 48 is used to operate the oil pump 56. Moreover, lubricant oil is supplied to the timing gears 32, 36 and the bearing 60 from the oil pump 56. Furthermore, the shaft sealer 62 is disposed to prevent the lubricant oil supplied to the bearing 60 from entering the compression chamber 20. A screw-like groove is processed on the inner side of the shaft sealer 62. When the rotors 26, 28 rotate, the pressure is generated in the shaft sealer 62, and the lubricant oil is pushed back. In the present embodiment constituted as described above, when the revolution number of the motor 48 decreases, the revolution number of the compressor 12 also decreases, and the pressure generated in the shaft sealer 62 or a force of pushing back the oil also decreases.

Additionally, when the motor 48 rotates at a low speed, and the lubricant oil with the same pressure as that during the load operation is supplied to lubricating sites such as the bearing 60, the force of pushing back the lubricant oil by the shaft sealer 62 is reduced, and there is a possibility that the lubricant oil enters the compression chamber 20. However, according to the present embodiment, the oil pump 56 rotates in cooperation with the motor 48. Therefore, when the motor 48 is operated at a low speed, the oil pump 56 is also in a low-speed operation state, and the oil supply pressure and oil supply amount to the bearing 60, and the like can be reduced. Thereby, even during low-speed rotation, the oil can be prevented from entering the compression chamber 20.

In the aforementioned respective embodiments, the low speed side set frequency is set to the value in the air consumption ratio of 35%, but the frequency is not limited to this, and may be determined in consideration of the lower-limit frequency. Moreover, air is used as the operation gas, but needless to say, the similar effect can be obtained even from gases other than air.

As described above, according to the present invention, by controlling the revolution number of the motor to provide the low speed side set frequency, holding the rotation frequency at the low speed side set frequency and releasing air at the air consumption ratio of 35% or less, and subsequently operating the motor at the lower-limit frequency, the power consumption during the unload operation can be reduced.

What is claimed is:

1. A screw compression apparatus comprising: a screw compressor including a pair of female and male rotors; a motor, controlled by an inverter, for driving the compressor; pressure detecting means for detecting a pressure of an operation gas discharged from said screw compressor; and an air release valve for performing a control to release the operation gas compressed by said compressor to the atmosphere, said apparatus further comprising control means for controlling said motor and said air release valve, wherein the control means controls a rotation frequency of the motor by said inverter at an operation point at which a ratio of an air consumption on a demand side to a compressor rated discharge amount is larger than a predetermined set value, holds the rotation frequency of the motor at a constant value when the ratio indicates said set value or less, controls said air release valve to release the operation gas to the atmosphere after the pressure detected by said pressure detecting means reaches a set upper-limit pressure, and further lowers the rotation frequency of said motor after the pressure of the operation gas reaches an upper-limit pressure.

2. The screw compression apparatus according to claim 1 wherein when the operation gas pressure reaches the set upper-limit pressure, said control means controls said air release valve and said motor to release the operation gas to the atmosphere via the air release valve and to lower the rotation frequency of the motor.

3. The screw compression apparatus according to claim 1, further comprising a suction throttle valve for controlling an operation gas amount sucked by said compressor, wherein when the air consumption indicates the set value or less of the air consumption ratio, said control means closes said suction throttle valve and releases the operation gas to the atmosphere via said air release valve, and subsequently controls said motor to further lower the rotation frequency of said motor.

4. The screw compression apparatus according to claim 1, further comprising another air release valve which is disposed parallel to said air release valve.

5. An operation control method of a screw compression apparatus comprising: a screw compressor driven by a motor provided with an inverter; and pressure detecting means for detecting a pressure of an operation gas discharged from the compressor, said method comprising steps of: controlling a rotation frequency of the motor by the inverter when an air consumption on a demand side is larger than a predetermined set value; holding the rotation frequency of the motor at a constant value when the air consumption indicates the set value or less; controlling said air release valve to release the operation gas to the atmosphere when the pressure detected by said pressure detecting means reaches a set upper-limit pressure in this state; and further lowering the rotation frequency of said motor during or after air release.

6. The operation control method of the screw compression apparatus according to claim 5, further comprising a step of: when the pressure of the operation gas indicates the set upper-limit pressure, releasing the operation gas to the atmosphere via the air release valve and lowering the rotation frequency of the motor.

7. The operation control method of the screw compression apparatus according to claim 5 wherein the screw compression apparatus further comprises a suction throttle valve for controlling an operation gas amount sucked by said compressor, and the operation control method comprises steps of: when the air consumption indicates the set value or less, closing the suction throttle valve and releasing the operation gas to the atmosphere via the air release valve; and subsequently further lowering the rotation frequency of said motor.

8. An operation control method of a screw compression apparatus comprising: a screw compressor driven by a motor provided with an inverter; and pressure detecting means for detecting a pressure of an operation gas discharged from the compressor, said method comprising steps of: holding a rotation frequency of the motor at a first rotation frequency when an air consumption indicates a predetermined set value or less; and controlling the rotation frequency of said motor to provide a second rotation frequency lower than said first rotation frequency after the pressure detected by said pressure detecting means reaches a set upper-limit pressure in this state.

9. The operation control method of the screw compression apparatus according to claim 8, further comprising a step of releasing the operation gas compressed by the compressor to the atmosphere when said motor is held at the first rotation frequency and the pressure detected by said pressure detecting means reaches the set upper-limit pressure.

10. The operation control method of the screw compression apparatus according to claim 9, further comprising a step of operating said motor at a frequency higher than the second rotation frequency when said motor is operated at the second rotation frequency and before the air consumption returns to said set value.

11. The operation control method of the screw compression apparatus according to claim 8, further comprising steps of: decelerating said motor to provide a lower-limit frequency when said motor is operated at the second rotation frequency and the operation gas is released to the atmosphere; holding this state until the air consumption reaches the set value; and subsequently, when the set value is obtained, stopping air release after accelerating said motor to obtain the first rotation frequency.

12. A screw compression apparatus comprising:

a screw compressor including a pair of female and male rotors;

a motor, controlled by an inverter, for driving the compressor;

a pressure sensor for detecting a pressure of an operation gas discharged from said screw compressor; and an air release valve for performing a control to release the operation gas compressed by said compressor to the atmosphere, said apparatus further compressing a controller for controlling said motor and said air release valve, wherein the controller controls a rotation frequency of the motor by said inverter at an operation point at which a ratio of an air consumption on a demand side to a compressor rated discharge amount is larger than a predetermined set value, holds the rotation frequency of the motor at a constant value when the ratio indicates said set value or less, controls said air release valve to release the operation gas to the atmosphere after the pressure detected by said pressure sensor reaches a set upper-limit pressure, and further lowers the rotation frequency of said motor after the pressure of the operation gas reaches an upper-limit pressure.

13. The screw compression apparatus according to claim 1 wherein when the operation gas pressure reaches the set upper-limit pressure, said controller controls said air release valve and said motor to release the operation gas to the atmosphere via the air release valve and to lower the rotation frequency of the motor.

14. The screw compression apparatus according to claim 1, further comprising a suction throttle valve for controlling an operation gas amount sucked by said compressor, wherein when the air consumption indicates the set value or less of the air consumption ratio, said controller closes said suction throttle valve and releases the operation gas to the atmosphere via said air release valve, and subsequently controls aid motor to further lower the rotation frequency of said motor.

15. The screw compression apparatus according to claim 1, further comprising another air release valve which is disposed parallel to said air release valve.

* * * * *